US006813586B1

(12) United States Patent
Vock et al.

(10) Patent No.: US 6,813,586 B1
(45) Date of Patent: Nov. 2, 2004

(54) EVENT AND SPORT PERFORMANCE METHODS AND SYSTEMS

(75) Inventors: Curtis A. Vock, Boulder, CO (US); Perry Youngs, Longmont, CO (US); Adrian Larkin, Boulder, CO (US); Timothy Ryan, Boulder, CO (US)

(73) Assignee: PhatRat Technology, Inc., Niwot, CO (US)

( * ) Notice: Subject to any disclaimer, the term of this patent is extended or adjusted under 35 U.S.C. 154(b) by 258 days.

(21) Appl. No.: 09/657,111

(22) Filed: Sep. 7, 2000

Related U.S. Application Data

(60) Provisional application No. 60/152,688, filed on Sep. 7, 1999.

(51) Int. Cl.[7] ..... G02B 23/10

(52) U.S. Cl. ..... 702/166

(58) Field of Search ..... 702/166, 142, 702/141; 336/444; 701/4; 396/287; 348/157, 155, 143, 109, 142; 382/107, 128, 162; 73/178; 352/140, 141; 340/937; 209/587; 386/117; 748/142; 342/464

(56) References Cited

U.S. PATENT DOCUMENTS

| | | | | | |
|---|---|---|---|---|---|
| 3,710,335 | A | * | 1/1973 | Lepley | 342/464 |
| 5,109,425 | A | * | 4/1992 | Lawton | 382/107 |
| 5,404,163 | A | * | 4/1995 | Kubo | 348/142 |
| 5,838,365 | A | * | 11/1998 | Sawasaki et al. | 348/169 |
| 5,905,848 | A | * | 5/1999 | Yano et al. | 386/117 |
| 6,157,898 | A | * | 12/2000 | Marinelli | 702/141 |
| 6,324,296 | B1 | * | 11/2001 | McSheery et al. | 382/107 |
| 6,516,284 | B2 | * | 2/2003 | Flentov et al. | 702/142 |

* cited by examiner

*Primary Examiner*—John Barlow
*Assistant Examiner*—Tung Lau
(74) *Attorney, Agent, or Firm*—Lathrop & Gage, L.C.

(57) ABSTRACT

A digital camera system is provided to measure a moving sportsman, for example to determine peak altitude, spin ratio and airtime. A wireless triangulation system is provided to track a moving sportsman to determine metrics such as peak altitude, rotation, drop distance and airtime. A stride-rate system is provided to determine stride-rate or assist in training for sports such as roller-blading.

12 Claims, 2 Drawing Sheets

EVENT AND SPORT PERFORMANCE METHODS AND SYSTEMS

RELATED APPLICATIONS

This application claims priority to U.S. Provisional Application No. 60/152,688, filed Sep. 7, 1999, which is hereby incorporated by reference.

FIELD OF THE INVENTION

The invention relates to sport performance and measuring sport performance at events like the X-GAMES.

BACKGROUND OF THE INVENTION

Skiers and other athletes in sporting activities experience speed, airtime and other factors such as spin. Persons watching such athletes cannot quantitatively appreciate the actual speed, airtime and spin, for example, because the prior art does not make such measurements in a manner suitable for either the athlete or persons watching the athlete. The invention provides features to overcome the limitations of the prior art.

SUMMARY OF THE INVENTION

In one aspect, the invention provides systems and methods to monitor and gauge airtime, altitude and spin ratios for an event with a sportsman jumping into the air. For example, the US SKI team has aerial competitions where the team jumps off a ramp and lands in water. The invention of this aspect provides for measuring the time in the air (airtime), the peak altitude, and other factors such as spin ratios (how much the body spun, or how much one part of the body spun relative to other parts or relative to the sports vehicle, e.g., the ski).

DETAILED DESCRIPTION OF THE DRAWINGS

Figure 1:
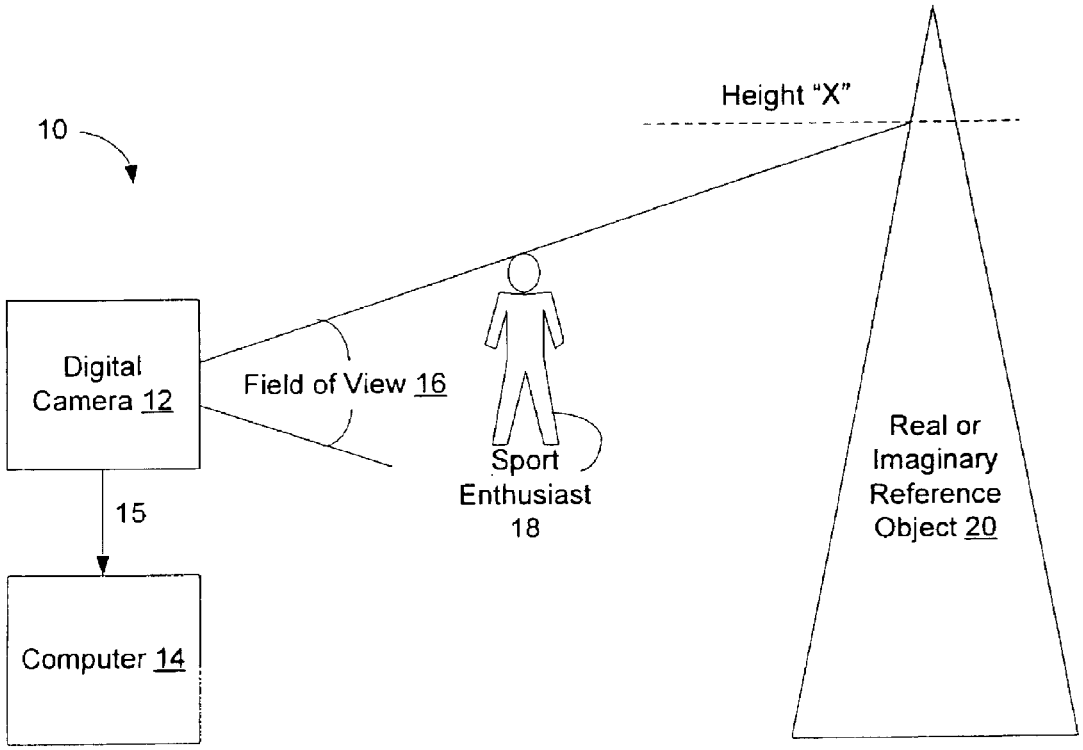
FIG. 1 shows a system to assess movement of a sportsman.

In FIG. 1, a digital camera 12 like a SONY DCR VX1000 takes a picture of a sportsman 18 jumping off a ramp 24. Data from the camera 12 goes to a computer 14 such as through an i-Link (IEEE 1394) or "firewire" link 15 to take digital data to the computer (those skilled in the art should appreciate that video data could alternatively be sent through the link 15 and then digitized by a frame-grabber in the computer 14.

Figure 2:
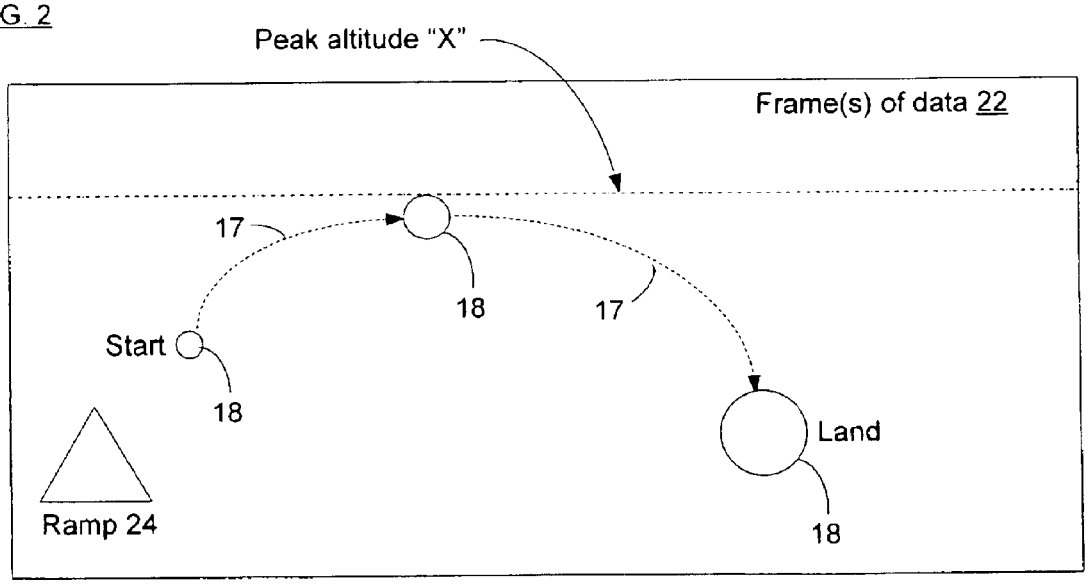
FIG. 2 illustrates frame-by-frame motion of the sportsman captured by the computer of FIG. 1.

Data taken from the computer 14 can be analyzed in a "frame by frame" technique to decipher motion of the sportsman 18 through the frames of data (typically captured at 30 Hz or more), as shown in FIG. 2. U.S. Pat. No. 5,798,519 provides similar processing of frame data and is thus incorporated by reference as useful for application with the invention. For example, since only the sportsman moves, the ramp 24 stays substantially fixed through the several frames of data and so it remains fixed though the sportsman moves from "start" to "stop" positions.

Altitude is determined by referencing the track 17 of the sportsman 18 relative to the object 20. Specifically, system

10 takes an image of the object 20 with a known height and compares that to the motion of the user. Trigonometric relations provide direct correlation to the user's actual height "x" along the track. By way of example, if the object 20 were a mountain at 14,000 feet, then by trigonometry ratios we know that that peak altitude of 14,000 feet corresponds to 50 feet at the sportsman's location. Another example is that an object such as a measuring tape is placed at the same location as the sportsman's track and stored in memory in the computer 14 so that the track 17 is compared relative to an actual height stored at that location through the tape. For instance, if for example one meter at the sportsman's position corresponds to twent-five pixels of imagery (either on screen or digitally, pixel by pixel of the camera 12), then this information correlates directly to the track 17 such that height "X" is determined.

Figure 3:
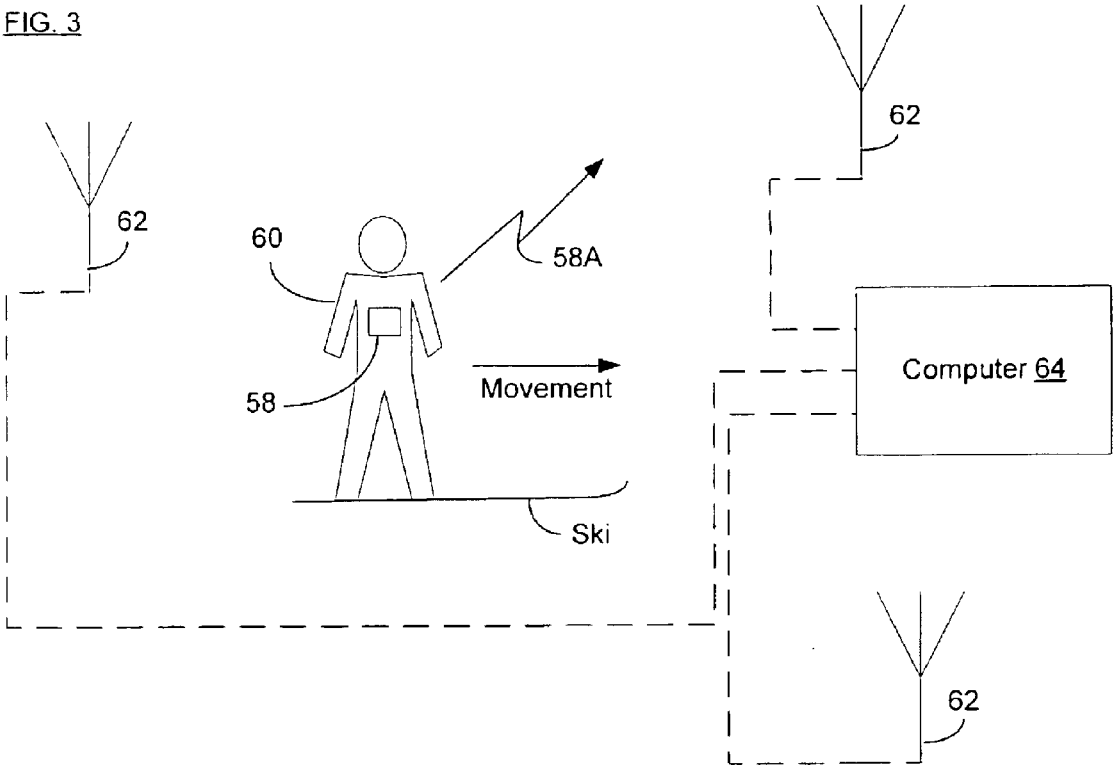
FIG. 3 illustrates 3D tracking of a sport enthusiast via triangulation.

In another embodiment, the invention of FIG. 3 provides 3D tracking of a sport enthusiast via triangulation through an emitter attached with the enthusiast. In this embodiment, a radio beacon 58 is attached to the sportsman 60, and antennas 62 capture the signal 58*a* from the beacon 58; and this data is compared at the computer 64 to "time" the receipt of signal 58*a* at each antenna 62 such that the sportsman's location is known at each moment of time. This location is, over time, evaluated to determine metrics such as peak altitude, rotation of the user, drop distance and time in the air.

Figure 4:
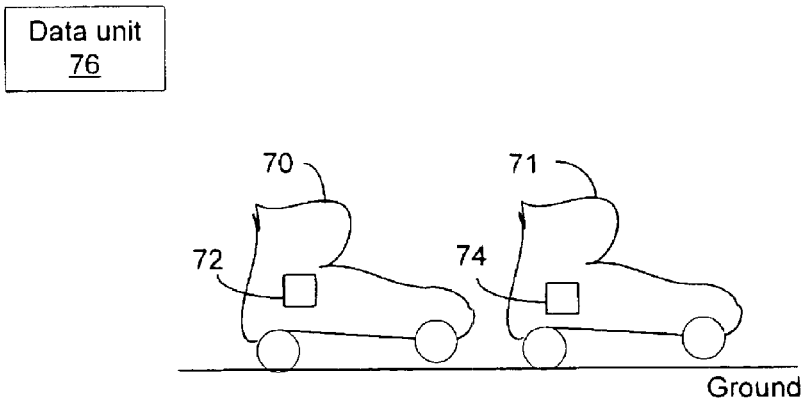
FIG. 4 shows stride-rate and training sensing units.

In another embodiment, the invention of FIG. 4 provides for stride-rate evaluation and training for sports such as roller blading. Specifically, two sensing units 72, 74 are attached to the vehicle (e.g., pair of roller blades 70, 72) as shown in FIG. 4 and these sensing units 72, 74 are evaluated by a common data unit 76 to determine stride rate and other useful sporting performance information.

U.S. Pat. No. 5,636,146 is incorporated herein by reference.

What is claimed is:

1. A method for determining peak altitude of a moving sportsman, comprising:

viewing the sportsman through a digital camera;

assessing frames of data provided by the digital camera to locate motion within the frames of data; and determining the peak altitude by comparing the highest point of motion by the sportsman within the frames of data to a reference object.

2. A method of claim 1, further comprising the steps of sending the frames of data to a computer through a data link and evaluating the frames of data to determine motion within the frames.

3. A method of claim 1, further comprising the step of capturing the frames of data at at least 30 Hz.

4. A method of claim 2, further comprising the step of automatically determining a motion track of the sportsman through time.

5. A method of claim 3, further comprising the step of capturing the frames of data at more than 60 Hz.

6. A method of claim 4, further comprising the step of determining airtime from the track.

7. A method of claim 4, further comprising the step of determining the speed of the sportsman by evaluating physical movement of the sportsman through successive frames of data.

8. A method of claim 6, wherein the camera comprises a digital camcorder and wherein the link comprises a Firewire connection.

9. A method of determining the airtime of a moving sportsman, comprising the steps of mounting a radio beacon on the sportsman, monitoring the location of the sportsman through triangulation to determine the location of the sportsman over time, and determining the airtime from the location over time.

10. A method of claim 9, further comprising determining a peak speed of the sportsman during motion of the sportsman by evaluating the location through successive time intervals.

11. A method of claim 9, further comprising determining a final speed of the sportsman just prior to a landing by determining a final speed of the sportsman just prior to the landing.

12. A method of claim 9, further comprising determining the airtime of the sportsman by evaluating the motion of the sportsman through the air from a first ground location to a landing location.

* * * * *